US012146490B2

(12) United States Patent
Liang et al.

(10) Patent No.: US 12,146,490 B2
(45) Date of Patent: Nov. 19, 2024

(54) COMPRESSION MECHANISM AND SCROLL COMPRESSOR

(71) Applicant: Copeland Climate Technologies (Suzhou) Co. Ltd., Jiangsu (CN)

(72) Inventors: Ji Liang, Suzhou (CN); Ping Zhao, Suzhou (CN); Meiling Xu, Suzhou (CN); Yuan Qian, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 83 days.

(21) Appl. No.: 17/917,852

(22) PCT Filed: Sep. 27, 2020

(86) PCT No.: PCT/CN2020/118017
§ 371 (c)(1),
(2) Date: Oct. 7, 2022

(87) PCT Pub. No.: WO2021/203639
PCT Pub. Date: Oct. 14, 2021

(65) Prior Publication Data

US 2023/0160386 A1 May 25, 2023

(30) Foreign Application Priority Data

Apr. 8, 2020 (CN) ..... 202010269675.1
Apr. 8, 2020 (CN) ..... 202020500164.1

(51) Int. Cl.
*F04C 29/12* (2006.01)
*F04C 18/02* (2006.01)
(Continued)

(52) U.S. Cl.
CPC ..... *F04C 18/0215* (2013.01); *F04C 18/0261* (2013.01); *F04C 18/0292* (2013.01); *F04D 27/023* (2013.01)

(58) Field of Classification Search
CPC .... F04C 28/128; F04C 28/26; F04C 18/0261; F04C 18/0215; F04C 18/0253; F04C 23/008
See application file for complete search history.

(56) References Cited

U.S. PATENT DOCUMENTS 4,774,816 A 10/1988 Uchikawa et al.
5,340,292 A 8/1994 Steele
(Continued)

FOREIGN PATENT DOCUMENTS

CN 102042224 A 5/2011
CN 103362802 A 10/2013
(Continued)

OTHER PUBLICATIONS

International Search Report (English and Chinese) and Written Opinion of the International Searching Authority (Chinese) issued in PCT/CN2020/118017, mailed Jan. 13, 2021; ISA/CN.
(Continued)

*Primary Examiner* — Deming Wan
(74) *Attorney, Agent, or Firm* — Harness, Dickey & Pierce, P.L.C.

(57) ABSTRACT

Disclosed are a compression mechanism and a scroll compressor. The compression mechanism comprises an orbiting scroll and a non-orbiting scroll comprising a non-orbiting scroll end plate and forms a series of fluid chambers comprising an intermediate compression chamber. An exhaust communication space is provided on the second side of the non-orbiting scroll end plate, and the non-orbiting scroll end plate is provided with a pressure relief port which makes at least one intermediate compression chamber be in selective fluid communication with the exhaust communication space. An end plate surface on the first side of the non-orbiting scroll end plate is provided with an exhaust groove which is in communication with the pressure relief port, the pressure
(Continued)

relief port can be in fluid communication with the at least one intermediate compression chamber through the exhaust groove.

14 Claims, 13 Drawing Sheets

(51) Int. Cl.

| | |
|---|---|
| ***F04C 23/00*** | (2006.01) |
| ***F04C 28/16*** | (2006.01) |
| ***F04D 27/02*** | (2006.01) |

(56) References Cited

U.S. PATENT DOCUMENTS

| | | | | |
|---|---|---|---|---|
| 2010/0300659 | A1* | 12/2010 | Stover | F04C 18/0215 165/104.31 |
| 2016/0348676 | A1* | 12/2016 | Ogata | F04C 18/0215 |
| 2018/0073505 | A1 | 3/2018 | Choi et al. | |
| 2019/0186491 | A1 | 6/2019 | Perevozchikov et al. | |
| 2019/0277284 | A1 | 9/2019 | Sun et al. | |

FOREIGN PATENT DOCUMENTS

| | | | |
|---|---|---|---|
| CN | 205401109 | U | 7/2016 |
| CN | 206246357 | U | 6/2017 |
| CN | 107489614 | A | 12/2017 |
| CN | 107893757 | A | 4/2018 |
| CN | 212202465 | U | 12/2020 |
| EP | 2549109 | A3 | 6/2016 |
| JP | S63140884 | A | 6/1988 |
| JP | H09119389 | A | 5/1997 |
| WO | 2018090809 | A1 | 5/2018 |

OTHER PUBLICATIONS

Chinese Office Action (in English and Chinese) regarding Application No. 202010269675.1, dated May 17, 2024.

Wang Jun et al, "Design of Discharge Port and the Characteristics of Discharging for Twinwrap Scroll Compressor", China Academic Journal Electronic Publishing House, 2008 (with machine translated English abstract).

* cited by examiner

COMPRESSION MECHANISM AND SCROLL COMPRESSOR

This application is the national phase of International Application No. PCT/CN2020/118017 titled "COMPRESSION MECHANISM AND SCROLL COMPRESSOR" and filed on Sep. 27, 2020, which claims the benefit of priorities to the following two Chinese patent applications: Chinese Patent Application No. 202010269675.1 titled "COMPRESSION MECHANISM AND SCROLL COMPRESSOR", filed with the China National Intellectual Property Administration on Apr. 8, 2020; and Chinese Patent Application No. 202020500164.1, titled "COMPRESSION MECHANISM AND SCROLL COMPRESSOR", filed with the China National Intellectual Property Administration on Apr. 8, 2020. These applications are entirely incorporated herein by reference.

FIELD

The present disclosure relates to a compression mechanism and a scroll compressor. More particularly, the present disclosure relates to a scroll compressor with a variable volume ratio.

BACKGROUND

The contents of this section only provide background information related to the present disclosure, which may not constitute the conventional technology.

Compressors may be used in application systems that require different pressures, such as air-conditioning systems, cold storage systems, low-temperature refrigeration systems, etc.. Therefore, there may be cases where the discharge pressure of the compression chamber (the maximum pressure in the compression chamber) is higher than the pressure required by a specific application system, that is, there may be over-compression. In the case of over-compression, the fluid compressed to the discharge pressure needs to be reduced to the pressure required by the application system after being discharged from the compression chamber. Therefore, the compression work corresponding to the pressure difference between the discharge pressure of the compressor and the pressure required by the application system is wasted, which results in reduced efficiency of the system.

In order to reduce or prevent over-compression of the working fluid, a compressor with a variable volume ratio has been developed. This type of compressor can realize the variable volume ratio by utilizing a pressure relief hole and a pressure relief valve assembly. Specifically, the pressure relief hole is provided in a non-orbiting scroll end plate, one end of the pressure relief hole is in communication with at least one compression chamber, the other end is in selective fluid communication with the exhaust port of the compressor through the exhaust communication space surrounded by the non-orbiting scroll hub on the non-orbiting scroll end plate. In a case that the pressure in the compression chamber reaches the required pressure, the pressure relief valve is opened, and the pressure relief hole is in communication with the exhaust communication space, so that the fluid in the compression chamber is discharged in advance through the pressure relief hole, so as to prevent the fluid from being over-compressed. Therefore, the compressor with the variable volume ratio can operate at a low volume ratio when the pressure required by the system is low and operate at a high volume ratio when the pressure required by the system is high, which can effectively avoid over-compression and improve the efficiency of the system.

However, in the compressor, since the position of the pressure relief hole is limited by the exhaust communication space, the position of the compression chamber with which the pressure relief could be in communication is limited. Therefore, the range of the variable volume ratio that the pressure relief hole can achieve is limited. In the case that the pressure required by the system is low, there may still be over-compression even if the pressure relief hole is used.

SUMMARY

An object according to the present disclosure is to solve or at least alleviate the above problems, that is, provide a scroll compressor with a pressure relief hole that can be in communication with the compression chamber as close to the outermost side of the compression mechanism as possible, so that the pressure of the fluid discharged from the pressure relief hole can be reduced as much as possible, thereby reducing or avoiding the over-compression and improving the efficiency of the system.

A compression mechanism is provided, which includes an orbiting scroll and a non-orbiting scroll, the orbiting scroll includes an orbiting scroll end plate and an orbiting scroll blade formed on a side of the orbiting scroll, the non-orbiting scroll includes a non-orbiting scroll end plate with a first side and a second side, a non-orbiting scroll blade formed on the first side of the non-orbiting scroll end plate, and a central exhaust port formed at the center of the non-orbiting scroll end plate, the non-orbiting scroll and the orbiting scroll cooperate to form a series of fluid chambers between the non-orbiting scroll and the orbiting scroll during the operation of the compression mechanism, the series of fluid chambers comprise a central compression chamber in communication with the central exhaust port, an air suction chamber in communication with an air suction port of the compression mechanism, and an intermediate compression chamber located between the central compression chamber and the air suction chamber; wherein an exhaust communication space is provided on the second side of the non-orbiting scroll end plate, and the non-orbiting scroll end plate is provided with a pressure relief port which makes at least one intermediate compression chamber be in selective fluid communication with the exhaust communication space, wherein an end plate surface on the first side of the non-orbiting scroll end plate is provided with an exhaust groove which is in communication with the pressure relief port, the pressure relief port can be in fluid communication with the at least one intermediate compression chamber through the exhaust groove.

Optionally, the exhaust groove extends outward from the pressure relief port substantially along a scroll profile direction of the non-orbiting scroll.

Optionally, the exhaust groove is provided to be exposable only to the intermediate compression chamber.

Optionally, the exhaust groove further extends inward from the pressure relief port substantially along the scroll profile direction of the non-orbiting scroll.

Optionally, the exhaust groove is provided to be exposable to the central compression chamber and the intermediate compression chamber. It should be noted that the wording "exposable" herein means that the exhaust groove is exposed to the central compression chamber and the intermediate compression chamber simultaneously at some time during the operation of the compressor or when the orbiting scroll moves to some positions.

Optionally, when the exhaust groove is exposed to the central compression chamber and the intermediate compression chamber at the same time, a smaller one of an area of the exhaust groove exposed to the central compression chamber and an area of the exhaust groove exposed to the intermediate compression chamber is less than or equal to 3% of an area of the central exhaust port. Optionally, both sides of the central exhaust port are provided with the pressure relief port, each side is provided with one or more pressure relief ports, and that for the pressure relief ports on each side, the exhaust groove is in communication with at least the outermost pressure relief port in a scroll profile direction of the non-orbiting scroll.

Optionally, a minimum radial distance between the pressure relief port and/or the exhaust groove and the non-orbiting scroll blade is less than 80% of a radial thickness of the orbiting scroll blade.

Optionally, a radial width of the exhaust groove and/or a radial width of the pressure relief port is less than or equal to 1.1 times of a radial thickness of the orbiting scroll blade.

Optionally, the exhaust groove includes an innermost end and an outermost end in a scroll profile direction of the non-orbiting scroll, a radial width of the exhaust groove remains constant or gradually increases from the innermost end to the outermost end.

Optionally, a radial cross section of the pressure relief port is configured in a circular shape or in a substantially long arc shape.

Optionally, the pressure relief port extends axially in a linear form or an offset form, that in the linear form, the pressure relief port is configured as a straight hole with one end in fluid communication with the at least one intermediate chamber and the other end in communication with the exhaust communication space, and that in the offset form, the pressure relief port includes a first section in fluid communication with the at least one intermediate chamber and a second section in communication with the exhaust communication space and the first section is offset radially outward relative to the second section.

Optionally, the non-orbiting scroll further includes a non-orbiting scroll hub formed on the second side of the non-orbiting scroll end plate, the non-orbiting scroll hub surrounds the central exhaust port to define the exhaust communication space.

A scroll compressor is provided according to the present disclosure, which includes the compression mechanism described above.

BRIEF DESCRIPTION OF THE DRAWINGS

The features and advantages of one or more embodiments of the present disclosure will become more readily understood from the following description with reference to the accompanying drawings. The drawings described herein are for illustrative purposes only, and are not intended to limit the scope of the present disclosure in any way. The figures are not to scale and some features may be exaggerated or minimized to show details of particular components. In the drawings.

DETAILED DESCRIPTION OF THE EMBODIMENTS

Embodiments are described more comprehensively with reference to the accompanying drawings.

The embodiments are provided such that the present disclosure will be thorough and will more fully convey the scope to those skilled in the art. Many specific details such as examples of specific components, devices, and methods are described to provide a thorough understanding of various embodiments of the present disclosure. It will be clear to those skilled in the art that the embodiments may be implemented in many different forms without using specific details, none of which should be construed as limiting the scope of the present disclosure. In some embodiments, well-known processes, well-known device structures, and well-known technologies are not described in detail.

Figure 1:
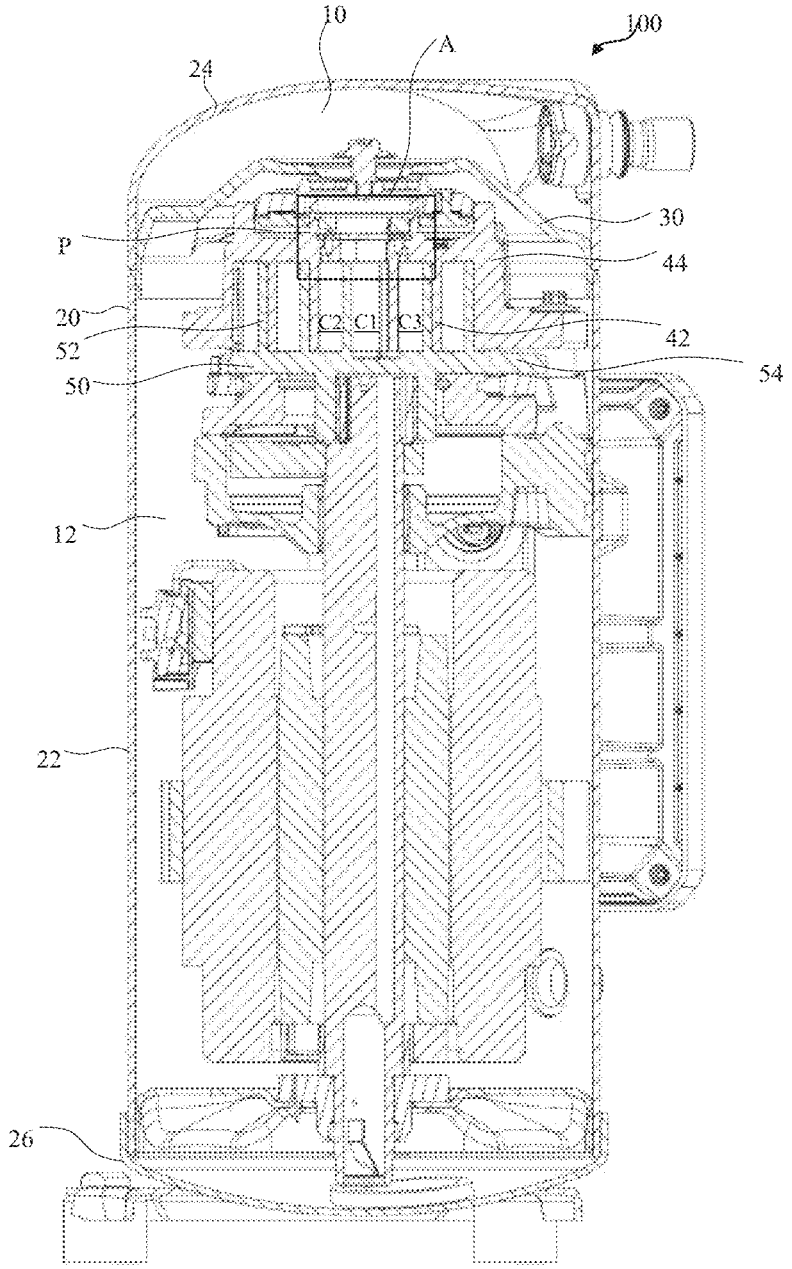
FIG. 1 is a longitudinal cross-sectional view of a scroll compressor according to a comparative example.

The general structure of a scroll compressor 100 is described below with reference to FIG. 1. As shown in FIG. 1, the compressor 100 includes a housing 20, a compression mechanism, a motor, a rotating shaft, and the like. The housing 20 may be constituted by a substantially cylindrical body portion 22, a top cover 24 arranged at one end of the body portion 22, and a bottom cover 26 arranged at the other end of the body portion 22. A partition plate 30 is provided between the top cover 24 and the body portion 22 to separate an internal space of the housing 20. A space between the partition plate 30 and the top cover 24 forms a fluid discharge chamber 10, and a space surrounded by the partition plate 30, the body portion 22 and the bottom cover 26 forms a fluid suction chamber 12. A suction joint for sucking fluid is provided on the side of the fluid suction chamber 12, and a discharge joint for discharging the compressed fluid is provided on the side of the fluid discharge chamber 10.

The compression mechanism includes a non-orbiting scroll 40 and an orbiting scroll 50. The motor is configured to drive the rotating shaft to rotate, and the rotating shaft is configured to drive the orbiting scroll 50 to orbit around the non-orbiting scroll 40 (that is, a central axis of the orbiting scroll revolves around a central axis of the non-orbiting scroll, but the orbiting scroll does not rotate around its own central axis) to compress the working fluid.

The non-orbiting scroll 40 may include a non-orbiting scroll end plate 44 and a non-orbiting scroll blade 42 extending from a first side of the non-orbiting scroll end plate 44. The orbiting scroll 50 may include an orbiting scroll end plate 54 and an orbiting scroll blade 52 formed on a side of the orbiting scroll end plate 54. The non-orbiting scroll blade 42 and the orbiting scroll blade 52 can be engaged with each other, so that a series of fluid compression chambers (such as an air suction chamber C0, a central compression chamber C1 and intermediate compression chambers C2, C3) are formed between the non-orbiting scroll blade 42 and the orbiting scroll blade 52 during operation of the scroll compressor, so as to compress the working fluid. Specifically, referring to FIG. 5*b* and FIG. 8*b*, among the fluid chambers, the radially outermost air suction chamber C0 in communication with an air suction port of the compression mechanism has a minimum pressure; the radially innermost fluid chamber, that is, the central compression chamber C1 located at the center of the scroll has a maximum pressure; and multiple intermediate compression chambers (such as C2, C3) located between the air suction chamber C0 and the central compression chamber C1 have intermediate pressures between the maximum pressure and the minimum pressure.

In order to realize fluid compression, an effective sealing is required between the non-orbiting scroll 40 and the orbiting scroll 50. Referring to the non-orbiting scroll shown in FIG. 2, generally, a second side, opposite to the first side, of the non-orbiting scroll end plate 44 is provided with a back pressure chamber P, so as to realize an axial sealing between a tip of the non-orbiting scroll blade 42 and the orbiting scroll end plate 54 and an axial sealing between a tip of the orbiting scroll blade 52 and the non-orbiting scroll end plate 44. The non-orbiting scroll 40 includes a non-orbiting scroll hub 48 and an annular wall 43 extending from the second side of the non-orbiting scroll end plate 44, and a central exhaust port is further formed at a substantial center of the non-orbiting scroll end plate 44. The back pressure chamber P is defined by a space surrounded by the non-orbiting scroll end plate 44, the non-orbiting scroll hub 48 and the annular wall 43, and is closed by a sealing assembly provided therein. The back pressure chamber P is in fluid communication with one intermediate pressure chamber of the compression chambers between the orbiting scroll 50 and the non-orbiting scroll 40 through an axially extending through hole formed in the non-orbiting scroll end plate 44, so as to provide the non-orbiting scroll 40 with a sealing pressure.

In another aspect, in order to avoid that the pressure of the fluid compressed by the central compression chamber C1 and discharged by the central exhaust port 46 is larger than the pressure required by the system, that is, in order to avoid the over-compression of the scroll compressor 100, a pressure relief port 47 (referring to FIG. 2) in communication with at least one intermediate compression chamber (such as the intermediate compression chamber C2 and/or the intermediate compression chamber C3) is defined in the non-orbiting scroll end plate 44, so that the fluid in the intermediate compression chamber C2 and/or the intermediate compression chamber C3 that has not been compressed into the central compression chamber C1 can be discharged in advance through the pressure relief port 47, thereby reducing the pressure of the discharged fluid of the scroll compressor.

Figure 2:
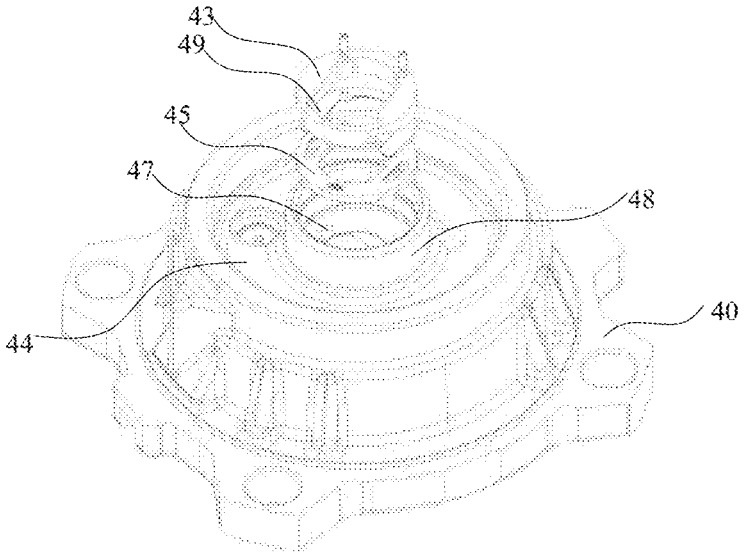
FIG. 2 is a partial exploded view of the scroll compressor in FIG. 1, which shows a non-orbiting scroll with a variable volume ratio.
Figure 3:
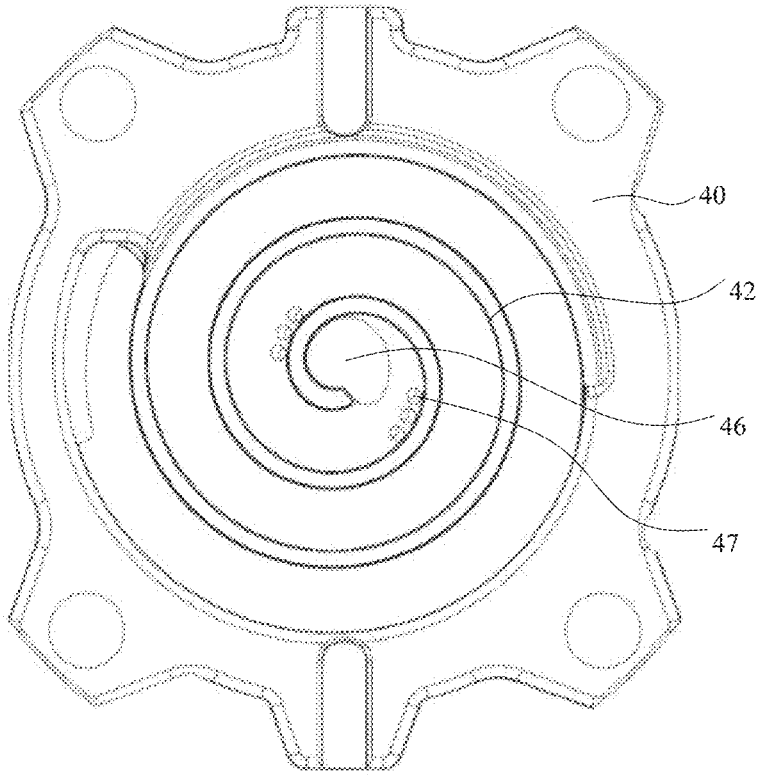
FIG. 3 is a bottom view of the non-orbiting scroll with the variable volume ratio in FIG. 2.

Referring to FIG. 2 and FIG. 3, the structure of the non-orbiting scroll provided with the pressure relief port 47 and a pressure relief assembly and a working process of the pressure relief port and the pressure relief assembly are described below. The non-orbiting scroll hub 48 is provided around the central exhaust port 46 to form an exhaust communication space S on the second side of the non-orbiting scroll end plate 44, and the exhaust communication space S surrounds the central exhaust port 46 and is in communication with the central exhaust port 46. The exhaust communication space S is separated from the back pressure chamber P by the non-orbiting scroll hub 48. The pressure relief port 47 is defined in the non-orbiting scroll end plate 44 in the exhaust communication space S. The pressure relief port 47 is generally a straight-through hole with a radial circular cross section and extending axially in a linear form, one end of the pressure relief port 47 is in communication with the exhaust communication space S, and the other end is in communication with the at least one intermediate compression chamber. In addition, a pressure relief valve is provided in the exhaust communication space S defined by the non-orbiting scroll hub 48. The pressure relief valve includes a valve plate 61, a valve flap 62, a valve holder 63, a pin 64 and the like. The valve plate 61 is provided with through hole (shown as two through holes in FIG. 2) at position corresponding to the pressure relief ports 47. The valve flap 62 is provided on the valve plate 61 to selectively open or close the through holes on the valve plate 61. The valve holder 63 is provided on the valve flap 62. The pin 64 extends through pin holes formed in the valve plate 61, the valve flap 62 and the valve holder 63 to fix the valve plate 61, the valve flap 62, and the valve holder 63.

During the operation of the compressor 100, the working fluid is sucked into the compression mechanism and is gradually compressed as it flows from the air suction chamber C0 to the central compression chamber C1, and the compressed fluid is discharged through the central exhaust port 46 in communication with the central compression chamber C1, then is discharged to the discharge chamber 10 via a check valve arranged at the center of the partition plate 30. In the case of over-compression, the fluid can be discharged to the exhaust communication space S in advance through the pressure relief port 47 and the pressure relief assembly before reaching the central compression chamber C1. Specifically, in a case that the pressure of the fluid in the intermediate compression chamber (such as the compression chamber C1 and/or the compression chamber C2) is larger than the pressure of the fluid in the discharge chamber 10 (that is, over-compression occurs), a pressure at the lower side of the valve flap 62 is larger than a pressure at the upper side thereof, and the valve flap 62 moves toward an open position under the pressure difference, thereby allowing the fluid to be discharged in advance through the pressure relief port 47 and the through holes on the valve plate 61. In a case that the pressure of the fluid in the intermediate compression chamber (such as the compression chamber C1 and/or the compression chamber C2) is smaller than the pressure of the fluid in the discharge chamber 10, the valve flap 62 returns to a closed position under the elastic restoring force and the pressure difference, thereby closing the pressure relief port 47.

For the scroll compressor with the variable volume ratio, it is desirable to increase the range of the variable volume ratio as much as possible, so as to more effectively avoid over-compression. The pressure relief port is in communication with the compression chamber closer to on the radially outermost side (that is, the intermediate compression chamber closer to the air suction chamber C0), the exhaust pressure discharged through the pressure relief port is lower. Therefore, in order to provide lower exhaust pressure to adapt to different system requirements, the pressure relief port tends to be moved toward the radially outermost side of the compression mechanism to be located in a position as close to the radially outermost side as possible. However, it can be seen from the structure of the non-orbiting scroll shown in FIG. 2 and FIG. 3 that the pressure relief port 47 is limited within the exhaust communication space S defined by the non-orbiting scroll hub 48 due to the arrangement of the back pressure chamber P, so the distance that the pressure relief port 47 is moved toward the radially outermost side of the compression mechanism is limited, thereby the pressure difference between the pressure of the fluid in the intermediate compression chamber in communication with the pressure relief port 47 and that in the central compression chamber C1 is limited.

Figure 4:
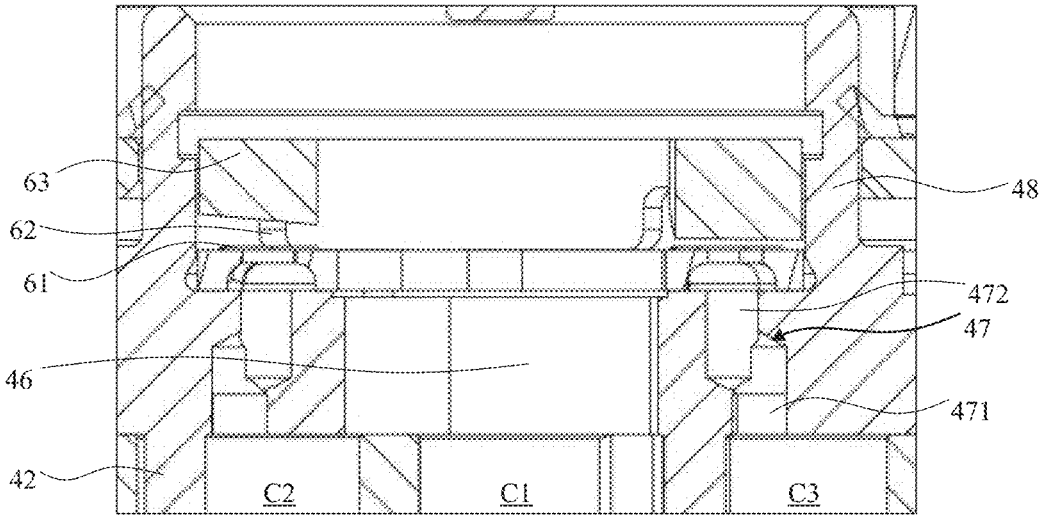
FIG. 4 is a detail view of block A in FIG. 1, which shows an offset pressure relief port.

FIG. 4 is a partial detail view of block A in FIG. 1. In order to enable the pressure relief port 47 to be in communication with the intermediate compression chamber closer to the radially outermost side, as shown in FIG. 4, the pressure relief port 47 may be configured to include a first section 471 in communication with the intermediate compression chamber and a second section 472 in selective communication with the exhaust communication space S. The first section 471 is in communication with the second section 472, and a central axis of the first section 471 is offset radially outward relative to a central axis of the second section 472, thereby forming an offset pressure relief port 47. Compared with the pressure relief port extending axially in the linear form, the offset pressure relief port 47 extending in the offset form can be in communication with the intermediate compression chamber closer to the radially outermost side, so that the pressure of the fluid discharged through the pressure relief port 47 is lower, which can more effectively avoid the over-compression.

However, for the offset pressure relief port 47, the distance by which the first section 471 is offset radially outward is limited due to the limitation of a size of the port.

The scroll compressor is provided according to the present disclosure, which includes a new design of the pressure relief port which enables the pressure relief port to be in communication with the intermediate compression chamber closer to the radially outermost side, so that the pressure of the fluid discharged through the pressure relief port is lower, which can more effectively avoid the over-compression. The embodiments of the present disclosure is described below with reference to FIG. 5*a* to FIG. 9, except that the design of the pressure relief port is different from that of the scroll compressor 100 in the comparative example described above, the structure and the operation mode of the scroll compressor are the same as that of the scroll compressor 100 in the comparative example described above, thus they are not repeated herein.

Figure 5A:
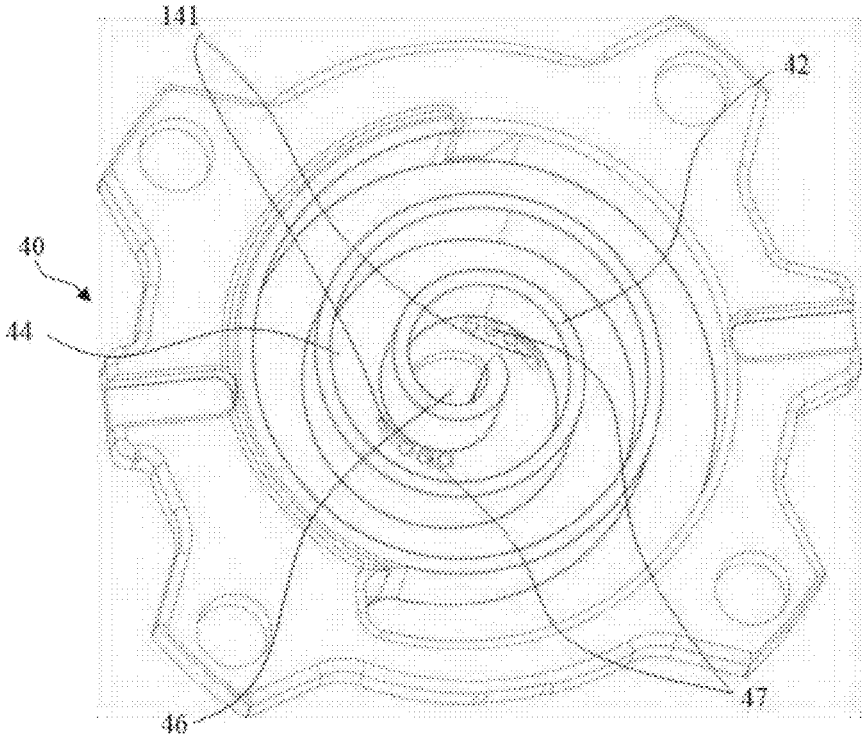
FIG. 5*a* is a partial schematic view of the non-orbiting scroll of the scroll compressor according to a first embodiment of the present disclosure.

FIG. 5*a* is a partial schematic view of the non-orbiting scroll of the scroll compressor according to a first embodiment of the present disclosure. As shown in FIG. 5*a*, the non-orbiting scroll 40 includes the non-orbiting scroll end plate 44 and the non-orbiting scroll blade 42, and pressure relief port 47 and the central exhaust port 46 located at the center are defined in the non-orbiting scroll end plate 44. The pressure relief port 47 is arranged on two sides of the central exhaust port 46, and the number of the pressure relief port 47 on each side is three. Similar to the scroll compressor 100 in the comparative example shown in FIGS. 1 to 4, one axial end of each pressure relief port 47 on each side is in communication with the exhaust communication space S on the second side of the non-orbiting scroll end plate 44, the other axial ends of the innermost pressure relief port and the intermediate pressure relief port in the scroll profile direction of the non-orbiting scroll blade 42 of the pressure relief ports 47 on each side are in direct communication with the intermediate compression chamber. However, different from the scroll compressor 100 in the comparative example, the other axial end of the outermost pressure relief port in the scroll profile direction of the non-orbiting scroll blade 42 of the pressure relief ports 47 on each side is in communication with an exhaust groove 141 and is in communication with the intermediate compression chamber through the exhaust groove 141. The exhaust groove 141 is formed on an end plate surface at the first side of the non-orbiting scroll end plate 44 and extends from the end plate surface at the first side of the non-orbiting scroll end plate 44 to the second side to the second side, and the extending depth of the exhaust groove 141 is as large as possible while the strength of the non-orbiting scroll end plate 44 is ensured, so that more fluid could enter the exhaust groove 141, but the maximum extending depth does not exceed a thickness of the non-orbiting scroll end plate 44. In addition, the exhaust groove 141 extends outward from the pressure relief port 47 substantially along the scroll profile direction of the non-orbiting scroll 40, so that the exhaust groove 141 can only be exposed to the intermediate compression chamber.

It should be noted that the number of the pressure relief port 47 on each side can be one or other numbers, the pressure relief port 47 can be in a shape of an axial straight hole, or the offset hole as shown in FIG. 4 for stacking its effect with the effect of the exhaust groove 141. The exhaust groove 141 may not only be in communication with the outermost pressure relief port along the scroll profile direction of the non-orbiting scroll 40 of the pressure relief ports 47 on each side, but also be in communication with multiple pressure relief ports including the outermost pressure relief port along the scroll profile direction of the non-orbiting scroll 40 of the pressure relief ports 47 on each side or in communication with all the pressure relief ports 47 on each side.

Figure 5B:
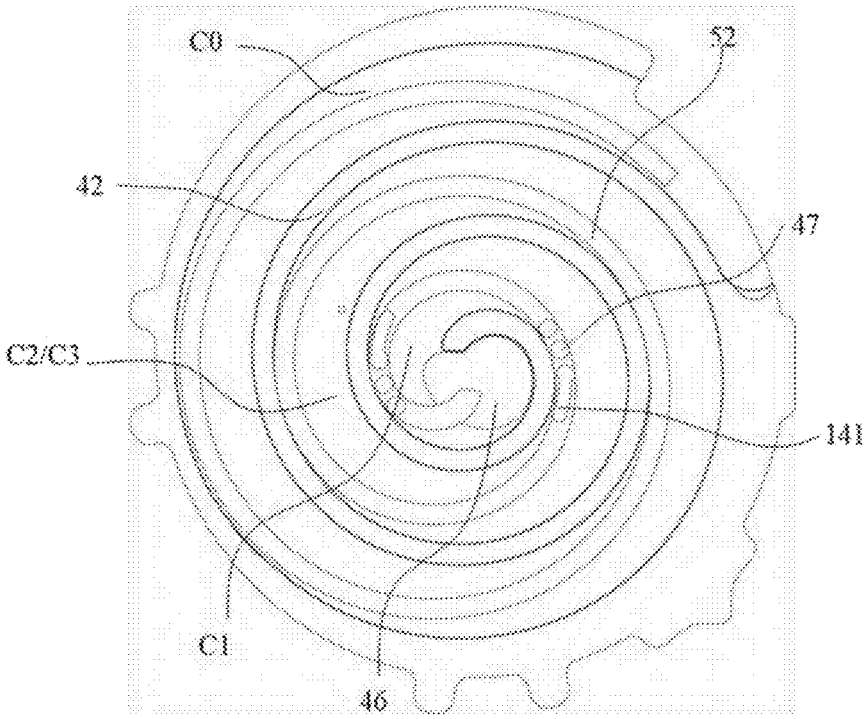
FIG. 5*b* is a partial perspective view of a compression mechanism of the scroll compressor according to the first embodiment of the present disclosure.
Figure 12:
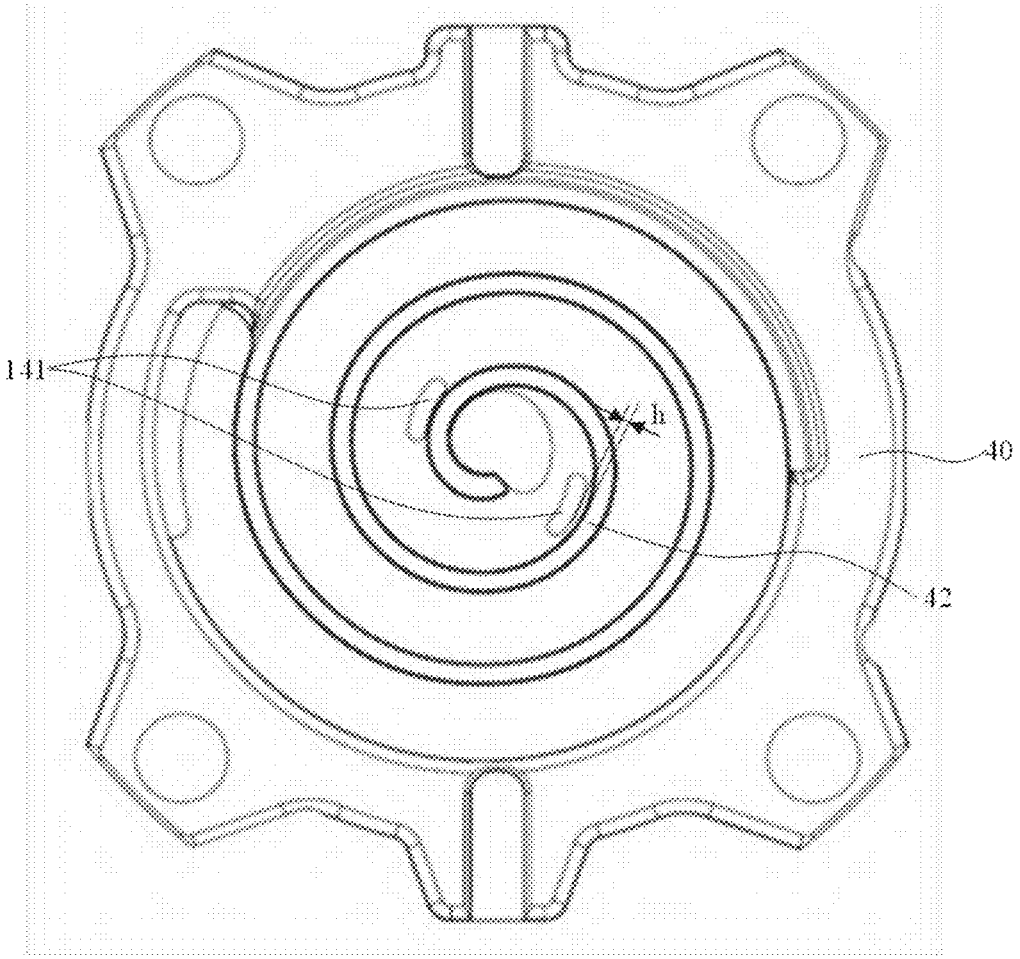
FIG. 12 is a schematic bottom view of the non-orbiting scroll of the scroll compressor according to the first embodiment of the present disclosure, which shows a minimum distance h between the exhaust groove and a non-orbiting scroll blade.

During the operation of the compressor, as shown in FIG. 5*b*, as the orbiting scroll 50 orbits round the non-orbiting scroll 40, the orbiting scroll blade 52 sometimes covers the pressure relief ports 47 and the exhaust grooves 141, and sometimes exposes the pressure relief ports 47 and the exhaust grooves 141 to the intermediate compression chamber. Preferably, a minimum distance h (as shown in FIG. 12) between the pressure relief port 47 with the exhaust groove 141 and the non-orbiting scroll blade 42 is smaller than 80% of a radial thickness of the orbiting scroll blade 52, so as to ensure that the orbiting scroll blade 52 can cover the pressure relief port 47 and the exhaust groove 141 during orbiting, and thus prevent the exhaust groove 141 from directly communicating two adjacent compression chambers and causing the fluid leakage. Since the exhaust groove 141 extends outward from the pressure relief port 47, the exhaust groove 141 can be exposed to the intermediate compression chamber earlier, that is, the exhaust groove 141 can be in communication with the intermediate compression chamber closer to the radially outermost side. The fluid in the intermediate compression chamber enters the pressure relief port 47 through the exhaust groove 141 and is discharged to the exhaust communication space S. Compared with comparative example in which the exhaust groove 141 is not provided (referring to FIG. 1 to FIG. 4), the exhaust groove 141 has the effect of "moving" the pressure relief port 47 toward the radially outer side, so that the pressure relief port 47 can be in communication with the intermediate compression chamber closer the radially outermost side through the exhaust groove 141, thereby discharging the fluid with lower pressure for meeting the requirements of the system.

Figure 10:
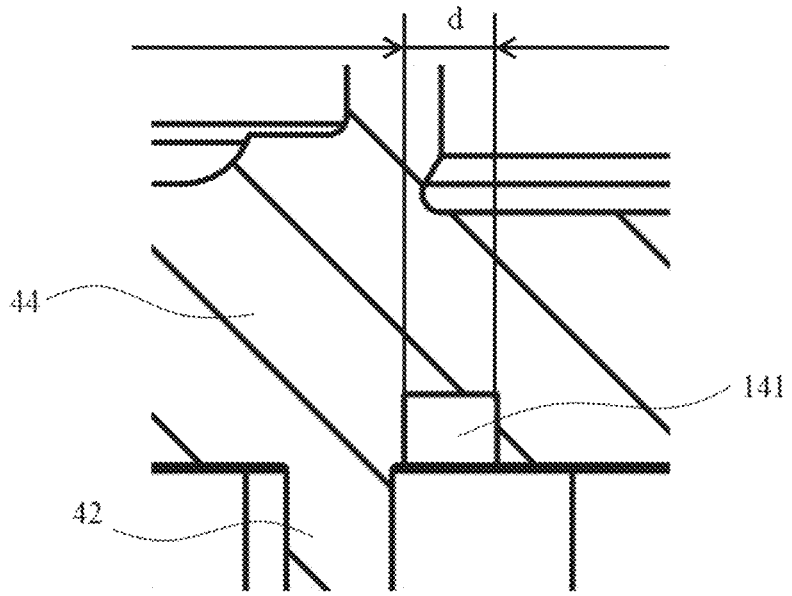
FIG. 10 is a partial longitudinal cross-sectional view of the scroll compressor according to the first embodiment of the present disclosure, which shows an exhaust groove.

On the other hand, referring to FIG. 10, a radial width (a diameter) of the pressure relief port 47 and/or a radial width d of the exhaust groove 141 generally remains constant. If the radial width (the diameter) of the pressure relief port 47 and/or the radial width d of the exhaust groove 141 is excessively large, for example, excessively exceeds the thickness b of the orbiting scroll blade 52, the orbiting scroll blade 52 cannot completely cover the pressure relief port 47 and/or the exhaust groove 141 all the time during the operation of the compressor, the adjacent two compression chambers (for example, the central compression chamber C1 and the intermediate compression chamber C2, or the central compression chamber C1 and the intermediate compression chamber C3) are communicated through the pressure relief port 47 and/or the exhaust groove 141. For example, in a case that the pressure relief valve is closed, the fluid in the higher pressure chamber (C1) of the adjacent two compression chambers leaks to the lower pressure chamber (C2 or C3) through the pressure relief port 47 and/or the exhaust groove 141, which results in repeated compression and reduced efficiency of the compressor. Therefore, preferably, the radial width (the diameter) of the pressure relief port 47 and/or the radial width d of the exhaust groove 141 is smaller or equal to 1.1 times of the thickness of the orbiting scroll blade 52, so as to avoid the fluid leakage between the two adjacent compression chambers of the compressor. In addition, a length of the exhaust groove 141 extending substantially along the scroll profile direction of the non-orbiting scroll blade 42 is defined such that the fluid cannot leak from the central compression chamber C1 to the intermediate compression chamber C2/C3 through the pressure relief port 47 and/or the exhaust groove 141 during the operation of the compressor.

Figure 6A:
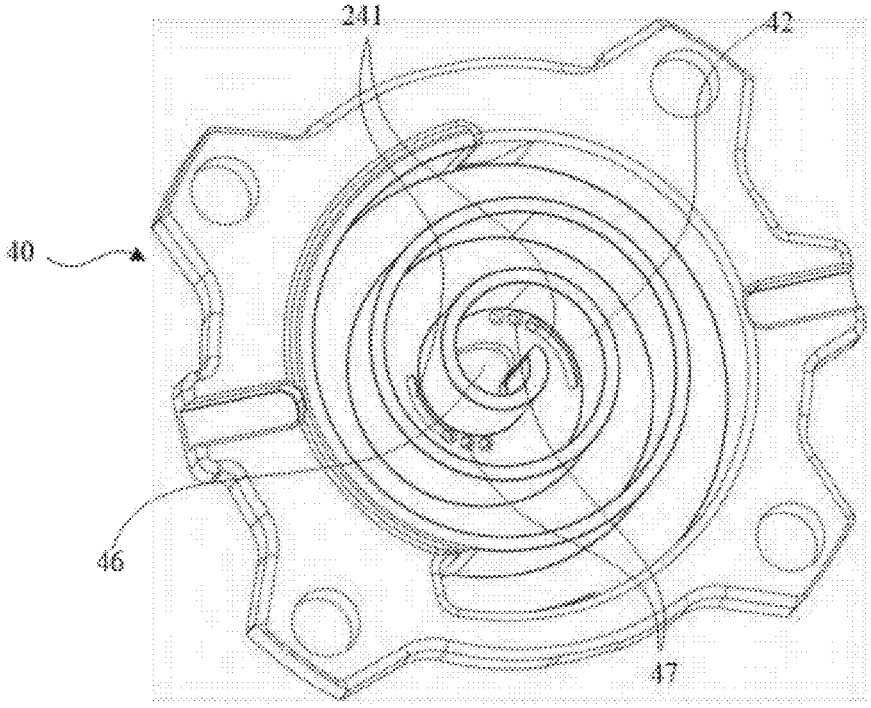
FIG. 6*a* is a partial schematic view of the non-orbiting scroll of the scroll compressor according to a second embodiment of the present disclosure.

FIG. 6*a* is a partial schematic view of the non-orbiting scroll of the scroll compressor according to a second embodiment of the present disclosure. Similar to the structure of the non-orbiting scroll according to the first embodiment of the present disclosure shown in FIG. 5*a* and FIG. 5*b*, the non-orbiting scroll 40 includes the non-orbiting scroll end plate 44 and the non-orbiting scroll blade 42, and pressure relief port 47 and the central exhaust port 46 located at the center are defined in the non-orbiting scroll end plate 44. The structure, position, number of the pressure relief port 47 are the same as that of the pressure relief port in the first embodiment, thus they are not repeated herein.

As shown in FIG. 6*a*, the pressure relief port 47 is in communication with the intermediate compression chamber through the exhaust grooves 241. The position, thickness, width and other parameters of the exhaust groove 241 are similar to the exhaust groove 141 in the first embodiment, except that the length of the exhaust groove 241 extending outward from the pressure relief port 47 substantially along the scroll profile direction of the non-orbiting scroll 40 is longer than that of the exhaust groove 141.

It can be understood by those skilled in the art that the longer the exhaust groove extends outward, the closer the intermediate compression chamber in communication with the exhaust groove is to the radially outermost side, the lower the pressure of the fluid in the intermediate compression chamber is, and the better effect of the scroll compressor with the variable volume ratio has to avoid the over-compression. Therefore, the exhaust groove 241 can be exposed to the intermediate compression chamber earlier than the exhaust groove 141, that is, the exhaust groove 241 can be in communication with the intermediate compression chamber closer to the radially outermost side.

Figure 6B:
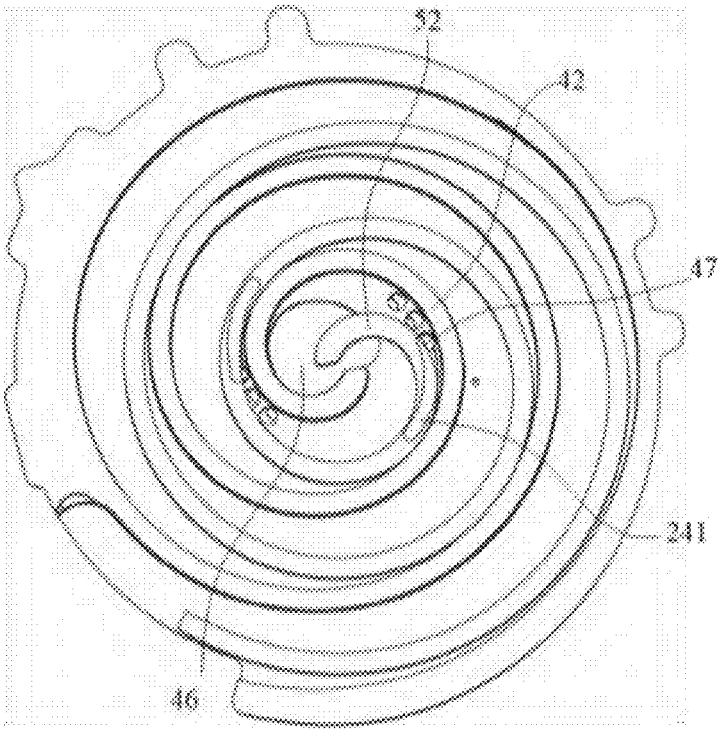
FIG. 6*b* is a partial perspective view of the compression mechanism of the scroll compressor according to the second embodiment of the present disclosure.

Certainly, the long length of the exhaust groove may lead to the fluid leakage between the compression chambers. In the second embodiment, as shown in FIG. 6*b*, the exhaust groove 241 enables only a small amount of leakage between the central compression chamber C1 and the intermediate compression chamber C2 and/or the central compression chamber C1 and the intermediate compression chamber C3. However, the small amount of leakage has little impact on the efficiency of the compressor especially when the system is under partial load. At least, the exhaust groove 241 cannot be in communication with the air suction chamber C0, so as to prevent the fluid leakage from affecting the efficiency of the compressor.

The test effects of the comparative example, the first embodiment and the second embodiment are described with reference to FIG. 11. The comparative example is provided with the offset pressure relief port, the first embodiment is provided with the offset pressure relief port and the relatively short exhaust groove 141, and the length of the relatively short exhaust groove 141 is arranged such that just no leakage occurs between the compression chambers, the second embodiment is provided with the offset pressure relief port and the relatively long exhaust groove 241, and the length of the long exhaust groove 241 is arranged such that only a small amount of leakage occurs between the compression chambers. Other structures of the compressor in the comparative example, the first embodiment and the second embodiment are completely identical and the compressor operates under same operating conditions.

The system operates within an envelope shown in FIG. 1. In a region above a scroll compression ratio line, the pressure required by the system is larger than or equal to the pressure provided by the compressor under full load (that is, the pressure of the fluid discharged through the central compression chamber C1). In a region below the scroll compression ratio line, the pressure required by the system is smaller than the pressure provided by the compressor under full load, and in this case, the pressure relief valve of the scroll compressor with the variable volume ratio is opened, the relatively low pressure fluid in the intermediate compression chamber is discharged in advance through the pressure relief port, thereby reducing the discharge pressure of the compressor. The dotted line shows a starting line (herein referred to as an activation starting line of the pressure relief valve in the comparative example) when the pressure relief valve of the scroll compressor in the comparative example is opened and the pressure relief port starts to discharge fluid. The region between the scroll compression ratio line and the activation starting line of the pressure relief valve is referred to as region 1, and the region below the activation starting line of the pressure relief valve is referred to as region 2. In the region 1, in a case that the pressure of the fluid in the intermediate compression chamber reaches the pressure required by the system, the pressure relief port is already able to communicate with the intermediate compression chamber, and the fluid in the intermediate compression chamber can be discharged from the pressure relief port, so that the over-compression of the compressor can be completely avoided in theory in the region 1. In the region 2, in the case that the fluid pressure in the intermediate compression chamber reaches the pressure required by the system, the pressure relief port is not in communication with the intermediate compression chamber yet, but will be in communication with the intermediate compression chamber later, then the pressure of the fluid in the intermediate compression chamber has exceeded the pressure required by the system when the pressure relief port is in communication with the intermediate compression chamber, thus the over-compression can be alleviated but cannot be completely avoided in the region 2.

In the first embodiment, the pressure relief port 47 can be in communication with the intermediate compression chamber earlier through the exhaust groove 141, so that the activation starting line of the pressure relief valve in the first embodiment descends compared with the activation starting line of the pressure relief valve in the comparative example, and an area of the region 1 is increased, which can better alleviate or avoid the over-compression. In the second embodiment, since the exhaust groove 241 is longer than the exhaust groove 141, the pressure relief port 47 can be in communication with the intermediate compression chamber earlier through the exhaust groove 241, so that the activation starting line of the pressure relief valve in the second embodiment descends compared with the activation starting line of the pressure relief valve in the first embodiment, and the area of the region 1 is increased, which can better alleviate or avoid the over-compression.

Figure 11:
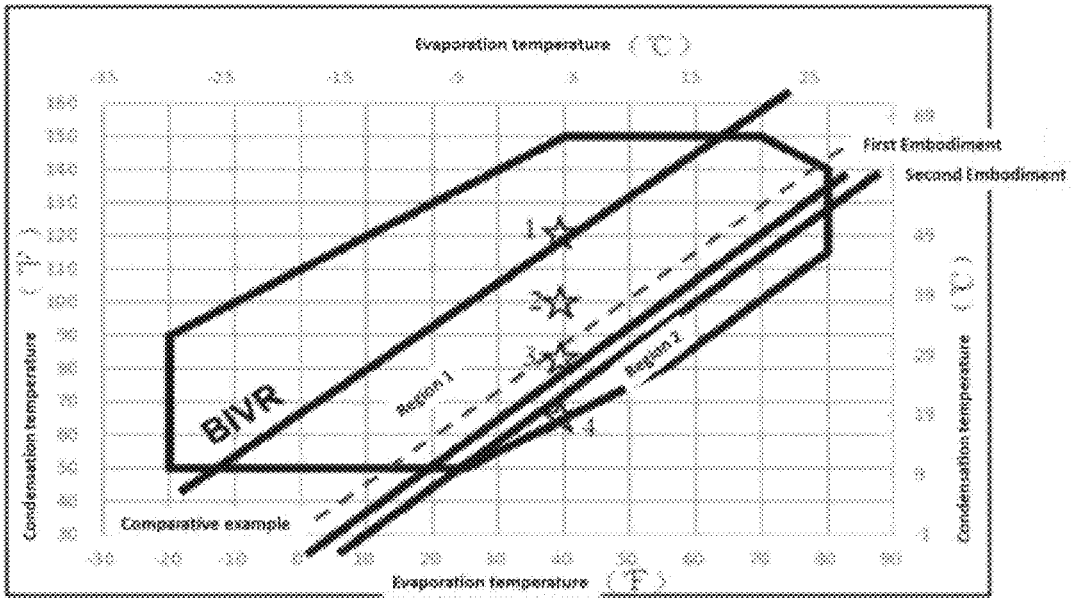
FIG. 11 is a comparison effect diagram of the comparative example, the first embodiment and the second embodiment of the present disclosure.

Taking working condition 3 in FIG. 11 as an example, in the comparative example, the working condition 3 is located in the region 2. In other words, the compressor in the comparative example may be over-compressed under the working condition 3. If the compressor in the first embodiment or the second embodiment is used, the over-compression can be completely avoided in theory. While, the test results show that the first embodiment significantly improves the efficiency of the working conditions 3 and 4 in FIG. 11, by about 1% and 2.5%, and the second embodiment improves the efficiency of the working condition 4 in FIG. 11 by about 2.8%.

Figure 7A:
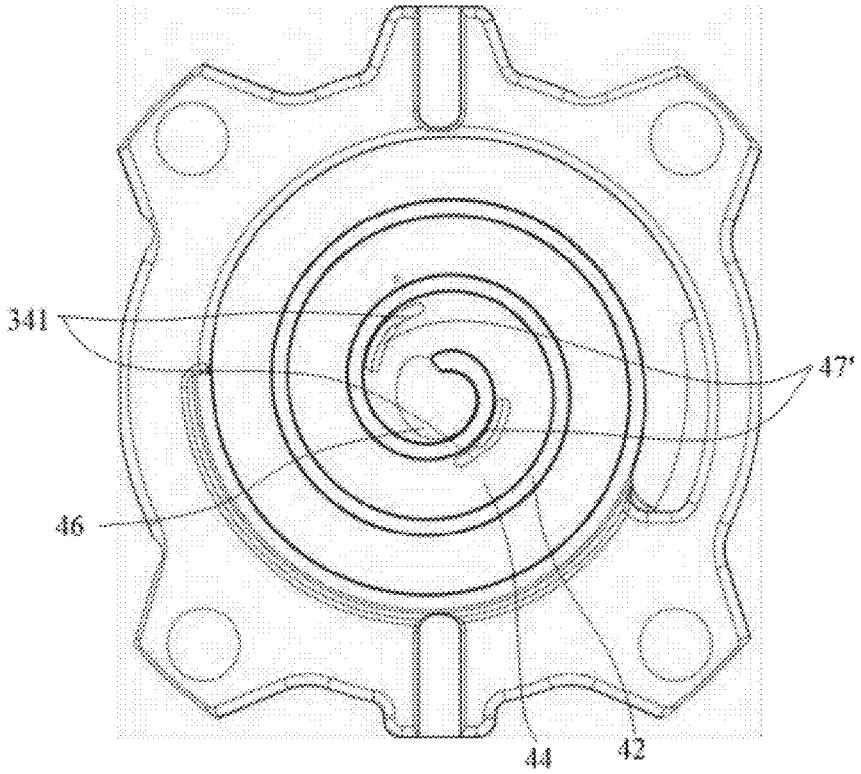
FIG. 7*a* is a partial schematic view of the non-orbiting scroll of the scroll compressor according to a third embodiment of the present disclosure.
Figure 7B:
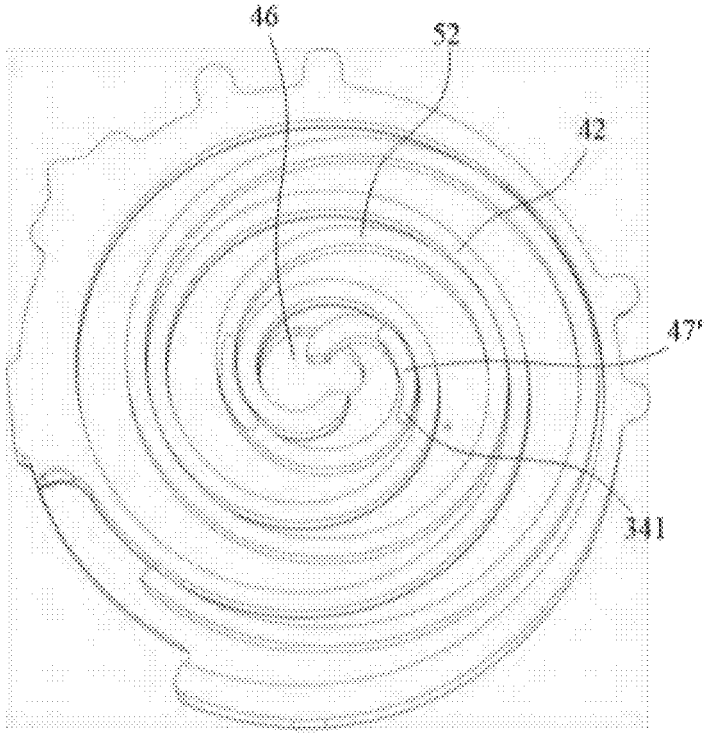
FIG. 7*b* is a partial perspective view of the compression mechanism of the scroll compressor according to the third embodiment of the present disclosure.

FIG. 7*a* and FIG. 7*b* show the non-orbiting scroll of the scroll compressor according to a third embodiment of the present disclosure. Similar to the structure of the non-orbiting scroll according to the first embodiment of the present disclosure shown in FIG. 5*a* and FIG. 5*b*, the non-orbiting scroll 40 includes the non-orbiting scroll end plate 44 and the non-orbiting scroll blade 42, and the central exhaust port 46 located at the center is defined in the non-orbiting scroll end plate 44. Different from the first embodiment, the non-orbiting scroll end plate 44 is no longer provided with the pressure relief ports 47 with the circular radial cross section, but is provided with the pressure relief ports 47' with a substantially long arc-shaped radial cross section, the pressure relief port 47' is arranged on two sides of the central exhaust port 46, and the number of the pressure relief port 47' on each side is one. The pressure relief ports 47' are configured in a form of a straight hole in axial direction, or configured in a form similar to the offset pressure relief port 47. Similar to the first embodiment, one axial end of each pressure relief port 47' is in communication with the exhaust communication space S on a side opposite to the non-orbiting scroll blade 42 of the non-orbiting scroll 40, the other end is in communication with the exhaust groove 341 and is in communication with the intermediate compression chamber through the exhaust groove 341. The exhaust groove 341 extends outward from the pressure relief port 47' along the scroll profile direction of the non-orbiting scroll blade 42. The position, thickness, width and other parameters of the exhaust groove 341 are similar to that of the exhaust groove 141 in the first embodiment.

Since a total area of the pressure relief ports 47' (that is, an area for pressure relief of exhaust) is increased compared with a total area of one or more pressure relief ports 47, the amount of the lower pressure working fluid discharged through the pressure relief ports 47' in the same time is increased, which can avoid the over-compression more effectively. In addition, it can be understood by those skilled in the art that, compared with the circular pressure relief port 47' shown in FIG. 5*a* and FIG. 5*b*, the substantially long arc-shaped pressure relief port 47' may bring the risk of fluid leakage between the compression chambers. Therefore, in the third embodiment, preferably, the length of the exhaust groove 341 extending from the pressure relief port 47' is arranged to be shorter than the exhaust groove 141, so that different compression chambers (such as between the central compression chamber C1 and the intermediate compression chamber C2 and/or between the central compression chamber C1 and the intermediate compression chamber C3) may not be communicated through the pressure relief port 47' and the exhaust groove 341, which avoids the fluid leakage between the compression chambers.

In the third embodiment, although the exhaust groove 341 is configured to be shorter than the exhaust groove 141 in the first embodiment for avoiding the fluid leakage between the compression chambers, since the pressure relief exhaust area is increased by the pressure relief port 47', more low pressure working fluid can be discharged. Therefore, the effect of alleviating or avoiding the over-compression in the third embodiment is substantially equivalent to that in the first embodiment.

It can be understood by those skilled in the art that the arrangement of the exhaust groove is not limited to the exhaust grooves 141, 241 and 341 in the first embodiment to the third embodiment described above, but any possible modification and combination with the circular pressure relief port 47 or the substantially long arc-shaped pressure relief port 47' are feasible. For example, as shown in the first modification example of the first embodiment shown in FIG. 8*a*, taking the pressure relief port 47 on either side of the central exhaust port 46 as an example, the exhaust groove 441 is in communication with the three pressure relief ports 47 on the corresponding side. In addition, the exhaust groove 441 not only extends outward from the pressure relief port 47 (the outermost pressure relief port along the scroll profile direction of the non-orbiting scroll) substantially along the scroll profile direction of the non-orbiting scroll 40, but also extends inward from the pressure relief port 47 (the innermost pressure relief port along the scroll profile direction of the non-orbiting scroll) substantially along the scroll profile direction of the non-orbiting scroll 40, while the exhaust groove 441 is not in communication with the central exhaust port 46. That is, in the first modification example, the exhaust groove 441 is not only exposed to the intermediate compression chamber, but also exposed to the central compression chamber C1.

Figure 8A:
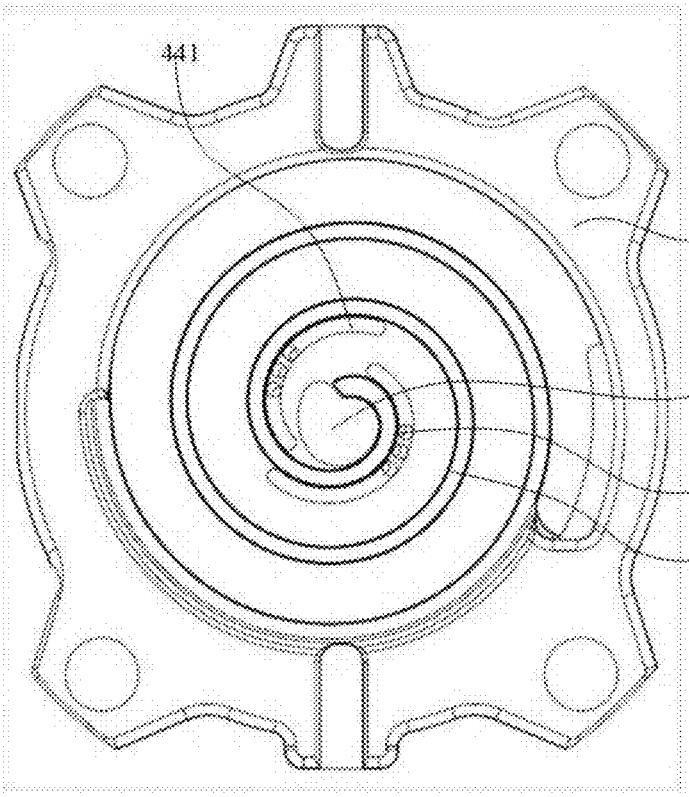
FIG. 8*a* and FIG. 8*b* are respectively a bottom view of the non-orbiting scroll of the scroll compressor and a cross-sectional view of the compression mechanism of a first modification example according to the first embodiment of the present disclosure.

For the first modification example in FIG. 8*a*, in a case that the portion extending inward of the exhaust groove 441 is relatively short, when the orbiting scroll blade moves to a certain position and the exhaust groove 441 starts to exhaust, the portion extending inward of the exhaust groove 441 is not in communication with the central exhaust port 46, but can increase a passage area of the pressure relief port 47 and can reduce the exhaust pressure loss; in a case that the portion extending inward of the exhaust groove 441 is relatively long, when the orbiting scroll blade moves to a certain position and the exhaust groove 441 starts to exhaust, the portion extending inward of the exhaust groove 441 is in communication with the central exhaust port 46, which can accelerate the exhaust process if the compressor operates at a low pressure ratio at this time.

Figure 8B:
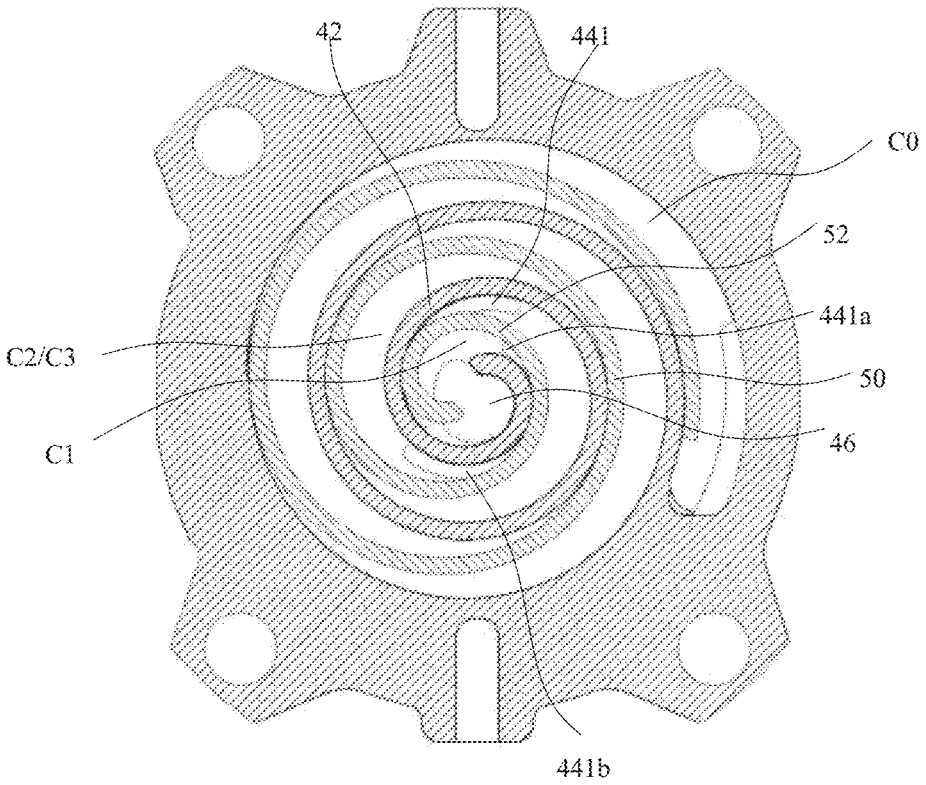

Referring to FIG. 8*b*, during the operation of the compressor, at certain times when the orbiting scroll 50 orbits to certain positions, the exhaust groove 441 and the central exhaust port 46 are exposed to the central compression chamber C1 together, the exhaust groove 441 has an area 441*a* which is exposed to the central compression chamber C1 at an innermost end of the exhaust groove 441 along the scroll profile direction, and the exhaust groove 441 has an area 441*b* which is exposed to the intermediate compression chamber C2 or C3 at an outermost end of the exhaust groove 441 along the scroll profile direction. The working fluid in the central compression chamber C1 can enter the exhaust groove 441 and the pressure relief port 47 through the area 441*a*, and then flow into the adjacent intermediate compression chamber C2 or C3 through the area 441*b*, so that the fluid leakage occurs between the central compression chamber C1 and the intermediate compression chamber C2 or C3. In order to control the amount of fluid leakage and ensure the effect of alleviating and avoiding the over-compression, preferably, when the exhaust groove 441 and the central exhaust port 46 are exposed to the central compression chamber C1 together, the smaller one of the area 441*a* at the innermost end of the exhaust groove 441 and the area 441*b* at the outermost end of the exhaust groove 441 is smaller than or equal to 3% of the area of the central exhaust port 46.

In addition, it can be understood by those skilled in the art that, for the combination of the pressure relief port 47 and the long exhaust groove 241 that allows a small amount of fluid leakage in the second embodiment, in order to control the amount of fluid leakage and ensure the effect of alleviating and avoiding the over-compression, preferably, when the pressure relief port 47 and the central exhaust port 46 are exposed to the central compression chamber C1 together, the smaller one of the area of the pressure relief port 47 exposed to the central compression chamber C1 and the area of the exhaust groove 441 exposed to the intermediate compression chamber C2/C3 is smaller than or equal to 3% of the area of the central exhaust port 46. Similarly, for the combination of the pressure relief port 47' and the short exhaust groove 341 in the third embodiment, the exhaust groove 341 may be configured to be relatively long to allow a small amount of fluid leakage between the compression chambers. In order to control the amount of fluid leakage and ensure the effect of alleviating and avoiding the over-compression, the sizes of the pressure relief port 47' ad the exhaust groove 341 may be defined to be similar to those in the first embodiment and the second embodiment.

It should be noted that the exhaust groove 541 can be exposed to the central compression chamber C1 and the intermediate compression chamber, and can even extend across the intermediate compression chambers, but the exhaust groove 541 cannot be exposed to the air suction chamber C0, so as to prevent the compression chamber from being in communication with the air suction chamber C0 of the scroll mechanism through the exhaust groove 541, and prevent the fluid leakage from affecting the efficiency of the compressor.

Figure 9:
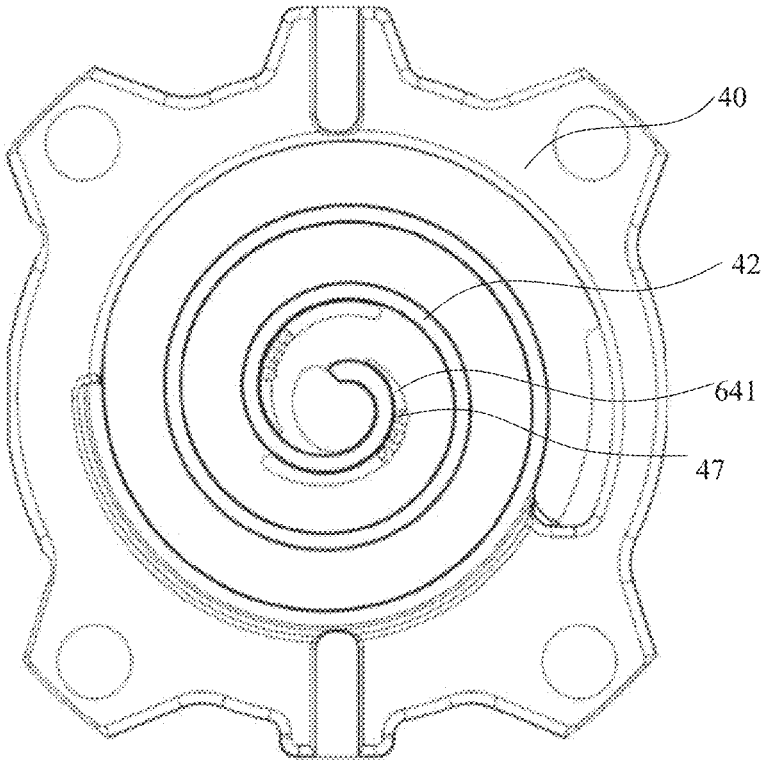
FIG. 9 is a bottom view of the non-orbiting scroll of the scroll compressor of a second modification example according to the first embodiment of the present disclosure.

FIG. 9 is a second modification example of the first embodiment. In the second modification example shown in FIG. 9, the radial width of the exhaust groove 641 is not constant, but gradually increases as it extends from an innermost end to an outermost end along the scroll profile direction of the non-orbiting scroll 40. That is, compared with the exhaust groove 441 shown in FIG. 8*a* and FIG. 8*b*, the exhaust groove 641 has the minimum width at the innermost end along the scroll profile direction of the non-orbiting scroll 40 and has the maximum width at the outermost end along the scroll profile direction of the non-orbiting scroll 40. Therefore, in case of fluid leakage between the compression chambers, the area which is exposed to the central compression chamber C1 at the innermost end of the exhaust groove 541 is decreased, which further reduces the amount of fluid leakage between the compression chambers, and thus improves the efficiency of the compressor, especially under high load.

While various embodiments of the present disclosure have been described herein in detail, it is conceivable that the present disclosure is not limited to the specific embodiments described and illustrated herein in detail, and other variations and modifications can be implemented by the person skilled in the art without departing from the essence and scope of the present disclosure. All these modifications and variations fall within the scope of the present disclosure. Moreover, all the members described herein can be replaced by other technically equivalent members.

The invention claimed is:

1. A compression mechanism, comprising:

an orbiting scroll, wherein the orbiting scroll comprises an orbiting scroll end plate and an orbiting scroll blade formed on a side of the orbiting scroll end plate; and a non-orbiting scroll, wherein the non-orbiting scroll comprises a non-orbiting scroll end plate with a first side and a second side, a non-orbiting scroll blade formed on the first side of the non-orbiting scroll end plate and a central exhaust port formed at the center of the non-orbiting scroll end plate, the non-orbiting scroll and the orbiting scroll cooperate to form a series of fluid chambers between the non-orbiting scroll and the orbiting scroll during the operation of the compression mechanism, the series of chambers comprise a central compression chamber in communication with the central exhaust port, an air suction chamber in communication with an air suction port of the compression mechanism, and an intermediate compression chamber located between the central compression chamber and the air suction chamber;

wherein an exhaust communication space is provided on the second side of the non-orbiting scroll end plate, the exhaust communication space is in communication with the central exhaust port, and the non-orbiting scroll end plate is provided with a pressure relief port which makes at least one intermediate compression chamber be in selective fluid communication with the exhaust communication space, wherein an end plate surface on the first side of the non-orbiting scroll end plate is provided with an exhaust groove which is in communication with the pressure relief port, the pressure relief port selectively communicates with the at least one intermediate compression chamber through the exhaust groove.

2. The compression mechanism according to claim 1, wherein the exhaust groove extends outward from the pressure relief port substantially along a scroll profile direction of the non-orbiting scroll.

3. The compression mechanism according to claim 2, wherein the exhaust groove is provided to be exposable only to the intermediate compression chamber.

4. The compression mechanism according to claim 2, wherein the exhaust groove further extends inward from the pressure relief port substantially along the scroll profile direction of the non-orbiting scroll.

5. The compression mechanism according to claim 4, wherein the exhaust groove is provided to be exposable to the central compression chamber and the intermediate compression chamber.

6. The compression mechanism according to claim 5, wherein when the exhaust groove is exposed to the central compression chamber and the intermediate compression chamber at the same time, a smaller one of an area of the exhaust groove exposed to the central compression chamber and an area of the exhaust groove exposed to the intermediate compression chamber is smaller than or equal to 3% of an area of the central exhaust port.

7. The compression mechanism according to claim 1, wherein both sides of the central exhaust port are provided with the pressure relief port, each side is provided with one or more pressure relief ports, and that for the pressure relief ports on each side, the exhaust groove is in communication with at least the outermost pressure relief port in a scroll profile direction of the non-orbiting scroll.

8. The compression mechanism according toe claim 1, wherein a minimum radial distance between the pressure relief port and/or the exhaust groove and the non-orbiting scroll blade is less than 80% of a radial thickness of the orbiting scroll blade.

9. The compression mechanism according to claim 1, wherein a radial width of the exhaust groove and/or a radial width of the pressure relief port is less than or equal to 1.1 times of a radial thickness of the orbiting scroll blade.

10. The compression mechanism according to claim 1, wherein the exhaust groove comprises an innermost end and an outermost end in a scroll profile direction of the non-orbiting scroll, a radial width of the exhaust groove remains constant or gradually increases from the innermost end to the outermost end.

11. The compression mechanism according to claim 1, wherein a radial cross section of the pressure relief port is configured in a circular shape or in a substantially long arc shape.

12. The compression mechanism according to claim 1, wherein the pressure relief port extends axially in a linear form or an offset form, that in the linear form, the pressure relief port is configured as a straight hole with one end in fluid communication with the at least one intermediate chamber and the other end in communication with the exhaust communication space, and that in the offset form, the pressure relief port comprises a first section in fluid communication with the at least one intermediate chamber and a second section in communication with the exhaust communication space and the first section is offset radially outward relative to the second section.

13. The compression mechanism according to claim 1, wherein the non-orbiting scroll further comprises a non-orbiting scroll hub formed on the second side of the non-orbiting scroll end plate, the non-orbiting scroll hub surrounds the central exhaust port to define the exhaust communication space.

14. A scroll compressor, wherein the scroll compressor comprises the compression mechanism according to claim 1.

* * * * *